United States Patent [19]

Miura et al.

[11] Patent Number: 4,938,808

[45] Date of Patent: Jul. 3, 1990

[54] MARTENSITIC STAINLESS STEEL SHEET HAVING IMPROVED OXIDATION RESISTANCE, WORKABILITY, AND CORROSION RESISTANCE

[75] Inventors: Kazuya Miura; Keiichi Yoshioka, both of Chiba, Japan

[73] Assignee: Kawasaki Steel Corporation, Kobe, Japan

[21] Appl. No.: 69,447

[22] PCT Filed: Mar. 4, 1986

[86] PCT No.: PCT/JP86/00108

§ 371 Date: Jun. 12, 1987

§ 102(e) Date: Jun. 12, 1987

[51] Int. Cl.[5] ..... C22C 38/18; C22C 38/06

[52] U.S. Cl. ..... 148/325; 420/34; 420/62

[58] Field of Search ..... 420/62, 34, 103, 128; 148/325

[56] References Cited

U.S. PATENT DOCUMENTS 2,999,039 9/1961 Lula et al. ..... 420/62
3,355,280 11/1967 Tuffnell et al. ..... 420/62
4,477,280 10/1984 Shiga et al. ..... 148/325

FOREIGN PATENT DOCUMENTS 54-56017 5/1979 Japan ..... 420/62
57-36341 8/1982 Japan .
59-177324 10/1984 Japan .

*Primary Examiner*—Deborah Yee
*Attorney, Agent, or Firm*—Young & Thompson

[57] ABSTRACT

Martensitic stainless steel sheet containing (in % by weight) 0.40% or less of C, 1.0% or less of Si, 1.0% or less of Mn, 0.6% or less of Ni, 10–14% of Cr. 0.025–0.30% of Al, and 0.025–0.060% of N, with the balance being iron and incidental impurities, has improved oxidation resistance, workability, and corrosion resistance. This type of stainless steel sheet is produced by a series of steps of hot rolling steel material of the above composition into a hot-rolled steel sheet, then softening by heating at a temperature in the range of 650°–900° C. for a short time within 300 seconds, and thereafter conducting pickling, cold rolling, and finish annealing. Moreover, in the above martensitic stainless steel sheet and the method of producing the same, it is desirable to set the Al content at 0.05–0.20% and/or the N content at 0.03–0.05%.

2 Claims, 2 Drawing Sheets

MARTENSITIC STAINLESS STEEL SHEET HAVING IMPROVED OXIDATION RESISTANCE, WORKABILITY, AND CORROSION RESISTANCE

DESCRIPTION

FIELD OF THE INVENTION

This invention relates to martensitic stainless steel sheet used in Western-type tableware and the like, and a method for producing the same. More particularly, it relates to martensitic stainless steel sheet which can be improved in oxidation resistance, workability, and corrosion resistance by short-duration annealing of hot-rolled sheet steel (annealing for softening), and to a method for practically producing such martensitic stainless steel sheet having improved oxidation resistance, workability, and corrosion resistance.

BACKGROUND OF THE INVENTION

Martensitic stainless steel is used in applications requiring relatively low corrosion resistance, such as knives, forks, and other table utensils, and generally contains as its components 11.5–14.0% of Cr, a maximum of 0.40% or less of C, 1.0% or less of Si, and 1.0% or less of Mn. A method commonly used to make it involves hot rolling a continuously cast slab or a slab obtained by ingot making and blooming, softening the hot-rolled sheet steel by batch-type annealing, then pickling, cold rolling, and finish annealing to give the product.

The batch-type annealing step used in the above-mentioned conventional manufacturing process to soften hot rolled steel generally takes a long time, typically tens of hours. When a hot-rolled sheet of chromium stainless steel is subjected to such prolonged annealing, a Cr-depleted layer forms on the surface of the hot-rolled steel sheet, presenting a serious problem especially in martensitic stainless steels having a relatively low Cr content. More specifically, formation of a Cr-depleted layer at the surface by annealing of hot-rolled steel sheet deteriorates the oxidation resistance of the sheet surface so that the finish annealing step of the cold-rolled strip production process that follows annealing of hot-rolled steel sheet might cause a thick undesirable scale to form on the surface of the steel sheet, leaving a problem of descaling. Also, after finish annealing, martensitic stainless steel is ordinarily polished as by buffing to give an aesthetic surface before use. But if the undesirable scale resulting from finish annealing remains, buffing work becomes extremely difficult.

To date, various counter measures have been employed for overcoming the problem of Cr-depleted layer formation. One approach is to extend the time of pickling following annealing of hot-rolled steel sheet to fully dissolve the outer surface to remove the Cr-depleted layer, thereby preventing deterioration of oxidation resistance during finish annealing. However, such an approach brings about new problems such as a longer pickling time, higher costs due to an increase in the quantity of pickling solution used, and difficult disposal of wasted pickling solution having a large amount of metals dissolved therein.

Making studies and experiments on ways to prevent formation of a Cr-depleted layer by shortening the time of hot-rolled steel sheet annealing and lowering the annealing temperature, the inventors found that, while merely shortening the hot-rolled steel sheet annealing time or lowering the annealing temperature has an observable effect of reducing the Cr-depleted layer on conventional martensitic stainless steel, the annealing of hot-rolled steel sheet achieves insufficient softening, resulting in cold rolled products which are markedly inferior in mechanical properties, especially workability.

In this regard, it was reported in Japanese Patent Publication No. 57-55787 that even when annealing of hot-rolled steel sheet is carried out for only a short time, ductility and workability are greatly improved by the addition of boron to chromium stainless steel. There remains, however, the problem of a pronounced decline in the corrosion resistance of boron-added steel due to the segregation of boron at grain boundaries.

An object of the present invention is, therefore, to provide a martensitic stainless steel capable of resolving the problems due to Cr-depleted layer formation, in that a hot-rolled sheet steel can be adequately softened even when annealing of hot-rolled sheet steel is substantially shortened to prevent formation of a Cr-depleted layer during the hot-rolled sheet steel annealing, typically the problem of oxidation resistance of cold-rolled steel sheet as well as the problem arising in conventional steels when the hot-rolled steel sheet annealing is of a short duration, namely, the deterioration of the mechanical properties of cold-rolled sheet steel, particularly the deterioration of workability. Another object of the present invention is to provide a practical method for the production of martensitic stainless steel sheet having improved oxidation resistance, workability, and corrosion resistance by short-duration annealing of a hot-rolled steel sheet.

DISCLOSURE OF THE INVENTION

Continuing studies and experiments on the composition of martensitic stainless steel to achieve the above objects, the inventors have found that by including 0.025–0.30% of Al and 0.025–0.060% of N in the steel, cold-rolled steel sheet having workability equal or superior to that available with conventional long-duration batch-type annealing can be obtained even when annealing of hot-rolled steel sheet is carried out for a short period of not more than 300 seconds.

Although a Cr-depleted layer with a thickness of about 3–6 μm normally forms at the completion of hot rolling in the outer surface of the hot-rolled martensitic stainless steel sheet, it has been found that annealing of hot-rolled steel sheet for a short time within about 300 seconds induces no further increase of the Cr-depleted layer during annealing, resulting in cold-rolled steel sheet having improved oxidation and corrosion resistances.

Therefore, the martensitic stainless steel sheet according to a first aspect of the present invention is characterized in that it contains 0.40% or less of C, 1.0% or less of Si, 1.0% or less of Mn, 0.6% or less of Ni, 10–14% of Cr, 0.025–0.30% of Al, and 0.025–0.060% of N, the balance consisting of iron and incidental impurities.

The method of production according to a second aspect of the present invention is a method for producing a martensitic stainless steel sheet, comprising a series of steps of hot rolling a steel material having the composition defined in the first aspect into a hot-rolled steel sheet, then conducting annealing for softening, and thereafter conducting pickling, cold rolling, and finish annealing, characterized in that the annealing for softening is conducted by heating at a temperature in the range of 650–900° C. for a short time within 300 seconds.

Preferably, in the first and second aspects of the present invention, the Al content is 0.05–0.20% and the N content is 0.03–0.05%.

DETAILED DESCRIPTION OF THE INVENTION

Figure 1:
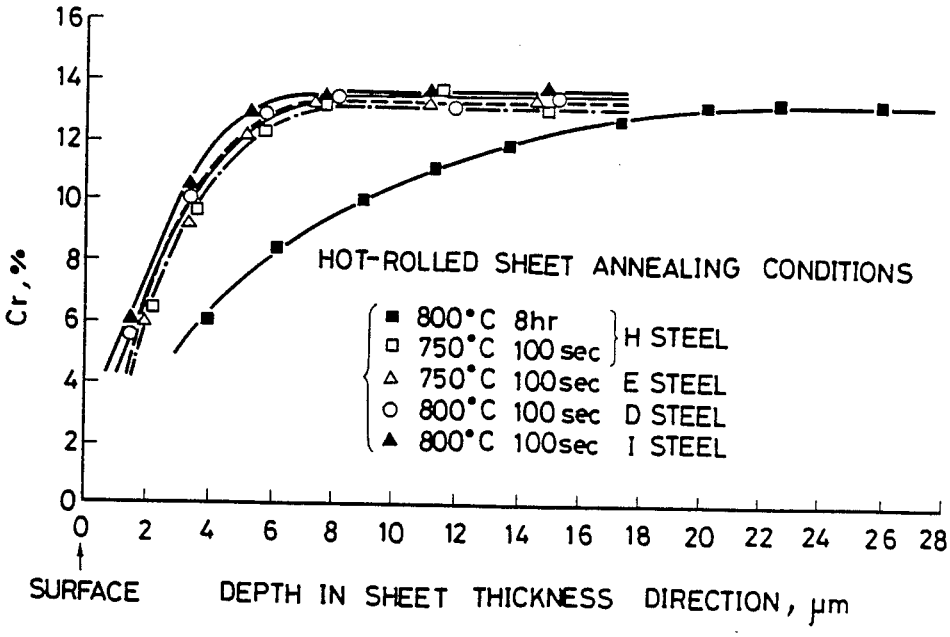
FIG. 1 is a graph showing the distribution of Cr concentration in the direction of sheet thickness in the outer layer of hot-rolled steel sheets after annealing, the hot-rolled sheets being annealed under various conditions.

The illustrative construction of the invention will be described in detail.

As noted above, in the present invention, by positively including aluminum and nitrogen in steel, the hot-rolled sheet steel can be fully softened even by annealing it for a very short duration of no more than 300 seconds. Because aluminum is an effective ferrite phase-forming element, it promotes a decrease of the martensite phase in the hot-rolled steel sheet and the transformation of martensite phase to ferrite phase during hot-rolled sheet steel annealing, enabling accelerated softening of the steel sheet.

Furthermore, it has also been discovered that when aluminum and nitrogen are both included in the steel, fine AlN grains precipitate abundantly within the steel sheet during hot rolling, and that recrystallization of the steel sheet is activated about the perimeter of these precipitates during high-temperature short-duration annealing, accelerating recrystallization and softening.

When the contents of aluminum and nitrogen are each less than 0.025%, a small amount of AlN precipitates during hot rolling and the effect of AlN precipitation accelerating recrystallization and softening during hot-rolled sheet steel annealing is not perceivable. Thus, the lower limits of aluminum and nitrogen are each set at 0.025%. On the other hand, an aluminum content of more than 0.30% does not increase this effect any further. Moreover, when the nitrogen content is in excess of 0.06%, further increase in the nitrogen hardens the steel sheet, causing such problems as occurrence of edge cracks and deterioration of mechanical properties. The upper limits of aluminum and nitrogen are thus set at 0.30% and 0.06%, respectively.

From the standpoint of preventing occurrence of cracks during hot rolling and softening by short-duration annealing, it is desirable that the optimum content of aluminum and/or nitrogen lies within the range of 0.05–0.20% for aluminum and the range of 0.03–0.05% for nitrogen.

The steel components other than aluminum and nitrogen may be essentially the same as in conventional prior art martensitic stainless steels. The reason for limitation of each component is given below.

Carbon is an essential element for assuring strength, but the steel sheet becomes harder with a carbon content in excess of 0.40%. The upper limit is thus set at 0.40%.

Silicon is effective as a deoxidizer, but the toughness declines at a content of over 1.0%. The upper limit is thus set at 1.0%.

Manganese is effective for enhancing both strength and toughness, but at a content of over 1.0% the mechanical properties of the sheet steel suffer. The upper limit is thus set at 1.0%.

Nickel is an element that improves corrosion resistance, but it is expensive. A compromise with cost sets the upper limit at 0.6%.

Chromium is a primary element in martensitic stainless steel. At least 10% is required to obtain the necessary corrosion resistance. Corrosion resistance improves further with the increasing content, but a type of wrinkling called ridging tends to form on steel during deep drawing at contents over 14%. The chromium content is thus set to the range of 10–14%.

In addition, phosphorus, sulfur, boron, and other elements are present as incidental impurities. From the standpoint of corrosion resistance of the stainless steel, the contents of phosphorus, sulfur, and boron are preferably reduced to 0.30% or less, 0.01% or less, and less than 2 ppm, respectively. A boron content of 2 ppm or more, in particular, gives rise to a ditch structure during a 10% oxalic acid electrolytic etching test (ASTM A 262), indicating a decline in corrosion resistance.

Thus the boron content should be less than 2 ppm to assure corrosion resistance.

In the production method according to the second aspect of the present invention, steel material of the above-described composition in the form of a continuously cast slab or a slab produced by ingot making and blooming is hot rolled by a standard process, and the resulting hot-rolled steel sheet is softened by holding it at a temperature in the range of 650–900° C. for a short time within 300 seconds. The subsequent steps are pickling, cold rolling, and finish annealing in this order according to the conventional process, obtaining a cold-rolled steel sheet.

By carrying out short-duration high temperature annealing on hot-rolled steel sheets, cold-rolled steel sheets having both improved oxidation resistance and workability can be obtained insofar as the steel has the above-mentioned composition. The conditions under which hot-rolled steel sheet is annealed for softening are limited for the following reason. First of all, with regard to the temperature, short duration annealing within 300 seconds at an annealing temperature of lower than 650° C. cannot give rise to full recrystallization or transformation of the martensite phase to a ferrite phase, resulting in insufficient softening. On the other hand, annealing at a temperature in excess of 900° C. is markedly effective for recrystallization, but produces coarser grains, resulting in deteriorated mechanical properties and such risks as formation of a Cr-depleted layer even within a short annealing time. The temperature at which hot-rolled steel sheet is softened is thus set in the range of 650–900° C. The holding time within the above temperature range is set within 300 seconds because not only the steel sheet recrystallizes and softens within a short annealing time of 300 seconds or less at the above temperature range to a sufficient extent to make longer retention unnecessary, but holding the steel sheet for more than 300 seconds also causes a Cr-depleted layer to form, resulting in a cold-rolled steel sheet having poor oxidation resistance.

BEST MODE FOR CARRYING OUT THE INVENTION

(EXAMPLE 1)

The test materials used were steels H–J as prior art steels and steels A–G as steels of the present invention having the chemical compositions shown in Table 1. Continuously cast slabs of each of the steels were hot rolled by a standard method into hot-rolled sheets with a thickness of 3.5 mm. Subsequently, the hot-rolled sheets of each of the steels were subjected to a hot-rolled sheet softening step by holding them for 100 seconds at different temperatures ranging from 650° C. to 900° C. in 50° C. intervals. In addition, H steel was subjected to conventional annealing, that is, long-duration batch-type annealing at 800° C. for 8 hours. Next, the hot-rolled steel sheets as annealed were pickled in two stages under the conditions shown in Table 2, and then cold rolled to a thickness of 1.8 mm, and finish annealed for one minute at 750° C.

FIG. 1 shows the chromium concentration distribution in the direction of the thickness of the steel sheets that were obtained by softening hot-rolled steel sheets under some typical conditions. FIG. 1 demonstrates that when the conventional method of long-duration (8-hour) batch-type annealing is applied to H steel, the Cr-depleted layer reaches a depth of about 20 μm from the surface of the steel sheet whereas short-duration (100-second) annealing applied to H, E, D, and I steels results in a Cr-depleted layer of only 6–7 μm deep. It is evident that formation of a Cr-depleted layer is inhibited by virtue of short duration annealing.

(EXAMPLE 2)

After pickling and cold rolling the hot-rolled, annealed steel sheets shown in FIG. 1 under the conditions shown in Table 2, the sheets were subjected to an oxidation resistance test by heating at 800° C., to determine a weight increase due to oxidation. The results are shown in FIG. 2.

Figure 2:
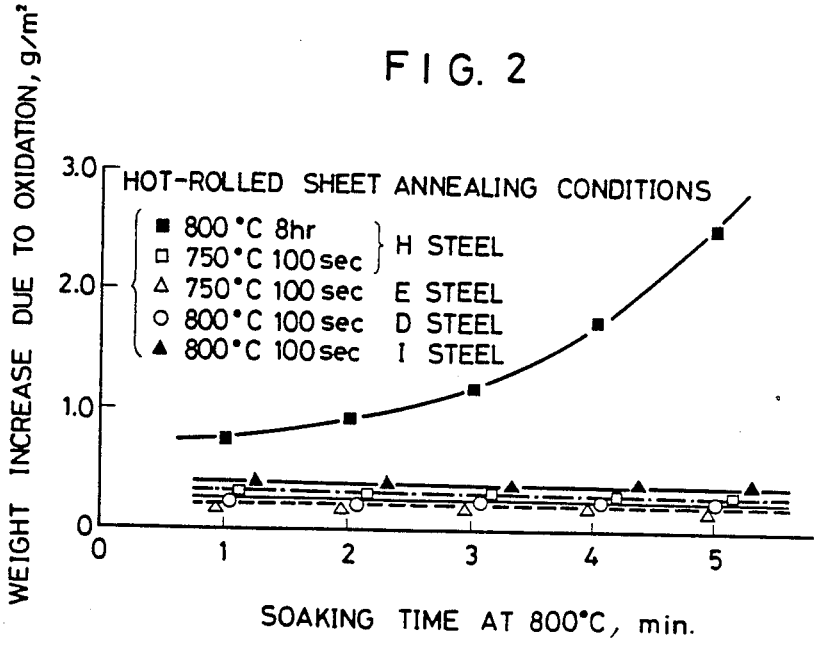
FIG. 2 is a graph showing the relationship between the time of soaking of cold-rolled steel sheets at 800° C. and the weight increase due to oxidation under the various conditions of annealing for hot-rolled steel sheets.

It is evident from FIG. 2 that H steel having undergone long-duration batch-type annealing of hot-rolled steel sheet yields a considerable weight increase due to oxidation, indicating inferior oxidation resistance of the cold-rolled sheet and formation of a thick coarse scale during finish annealing. On the other hand, when short-duration annealing is carried out on the respective steels, virtually no weight increase due to oxidation is observed. It is thus evident that the oxidation resistance of cold-rolled sheet steel is outstanding, and no coarse scale is formed by finish annealing.

(EXAMPLE 3)

Figure 3:
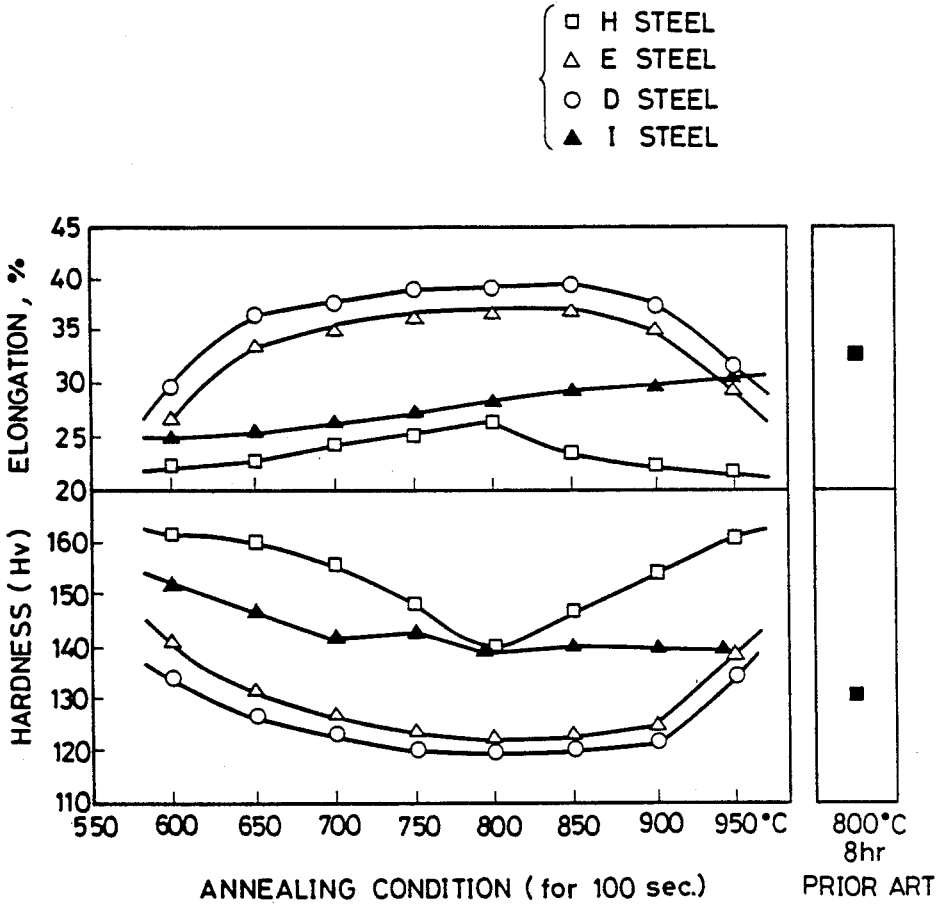
FIG. 3 is a graph showing the relationship between the elongation and hardness of cold-rolled sheet steel as finish annealed and the hot-rolled sheet annealing conditions for H, E, D, and I steels.

The H, E, D, and I steels were subjected to cold-rolling and finish annealing for one minute at 800° C. and determined for mechanical properties. The results are shown in FIG. 3 versus the annealing temperatures used in softening the hot-rolled steel sheets. It is evident from FIG. 3 that when short-duration annealing is carried out on the prior art H steel and I steel having a low nitrogen content, elongation and workability are poor at all the annealing temperatures, particularly, the workability is worse than when conventional batch-type annealing is carried out on H steel. Conversely, when short-duration annealing is carried out on steels E and D according to the present invention, the workability is good particularly at an annealing temperature of 650–900° C., and more excellent even compared with steels obtained by conventional long-duration annealing.

(EXAMPLE 4)

Next, the cold-rolled steel sheets obtained from steels A–J were held at 750° C. for 100 seconds. These cold-rolled, annealed steel sheets were measured for hardness (Hv), and subjected to a 10% oxalic acid electrolytic etching test to determine corrosion resistance. The results are shown in Table 3.

As seen from Table 3, steels A–G according to the present invention are soft compared with comparative steels H and I. Even in the 10% oxalic acid electrolytic etching test, the former acquires a step structure, exhibiting good corrosion resistance. On the other hand, J steel containing a high level of boron (more than 2 ppm) is soft, but assumes a ditch structure in the etching test indicating poor corrosion resistance.

The 10% oxalic acid electrolytic etching test mentioned above was conducted according to ASTM A 262.

The test results were evaluated as follows:

step (stepped structure): structure without ditches at grain boundaries ditch (ditch-like structure): structure having at least one crystal grain entirely surrounded by ditches

TABLE 1

| | | Chemical Composition (wt %) of Test Materials | | | | | | | | | |
|---|---|---|---|---|---|---|---|---|---|---|---|
| | | C | Si | Mn | P | S | Al | Cr | Ni | N | B* |
| Steels of Invention | A Steel | 0.06 | 0.31 | 0.50 | 0.030 | 0.004 | 0.040 | 12.9 | 0.10 | 0.035 | <2 |
| | B steel | 0.05 | 0.29 | 0.38 | 0.024 | 0.003 | 0.070 | 12.8 | 0.11 | 0.040 | <2 |
| | C steel | 0.05 | 0.33 | 0.39 | 0.026 | 0.002 | 0.17 | 13.0 | 0.06 | 0.032 | <2 |
| | D steel | 0.06 | 0.39 | 0.33 | 0.030 | 0.005 | 0.25 | 13.3 | 0.12 | 0.038 | <2 |
| | E steel | 0.03 | 0.40 | 0.39 | 0.032 | 0.005 | 0.10 | 13.3 | 0.08 | 0.027 | <2 |
| | F steel | 0.05 | 0.35 | 0.42 | 0.028 | 0.006 | 0.12 | 13.1 | 0.09 | 0.040 | <2 |
| | G steel | 0.05 | 0.36 | 0.35 | 0.030 | 0.007 | 0.14 | 12.7 | 0.08 | 0.055 | <2 |
| Comparative Steels | H steel | 0.06 | 0.38 | 0.39 | 0.033 | 0.005 | 0.002 | 13.2 | 0.10 | 0.035 | <2 |
| | I steel | 0.06 | 0.39 | 0.38 | 0.031 | 0.005 | 0.10 | 13.3 | 0.10 | 0.013 | <2 |
| | J steel | 0.04 | 0.34 | 0.45 | 0.029 | 0.003 | 0.12 | 13.0 | 0.11 | 0.012 | 5 |

*B content given in ppm

TABLE 2

| | Pickling Conditions | |
|---|---|---|
| | Solution 1 | Solution 2 |
| Pickling solution | $H_2SO_4$ | $HNO_3$ |
| Concentration, vol % | 20 | 12 |
| Solution temperature, °C. | 80 | 22 |
| Pickling time, sec. | 35 | 30 |

TABLE 3

| | Hardness and Results of 10% Oxalic Acid Electrolytic Etching Test | | | | |
|---|---|---|---|---|---|
| | Chemical component | | | | Evaluation of |
| | Al (wt %) | N (wt %) | B (ppm) | Hardness (Hv) | 10% oxalic acid electrolytic etch |
| | Steels of Invention | | | | |
| A steel | 0.040 | 0.035 | <2 | 136 | step |
| B steel | 0.070 | 0.040 | <2 | 126 | step |
| C steel | 0.17 | 0.032 | <2 | 128 | step |
| D steel | 0.25 | 0.038 | <2 | 136 | step |
| E steel | 0.10 | 0.027 | <2 | 135 | step |
| F steel | 0.12 | 0.040 | <2 | 126 | step |
| G steel | 0.14 | 0.055 | <2 | 134 | step |
| | Comparative Steels | | | | |
| H steel | 0.002 | 0.035 | <2 | 149 | step |
| I steel | 0.10 | 0.013 | <2 | 145 | step |
| J steel | 0.12 | 0.012 | 5 | 125 | ditch |

INDUSTRIAL APPLICABILITY

As understood from the foregoing description, the martensitic stainless steel sheet according to the first aspect of the present invention undergoes sufficient recrystallization and softening even with very short duration annealing of hot-rolled steel sheet because of appropriate contents of aluminum and nitrogen. As a result, it is possible to have adequate workability and corrosion resistance of the cold-rolled sheet steel, and at the same time, by shortening the time of annealing hot-rolled steel sheet, the formation of a Cr-depleted layer during annealing can be inhibited to substantially improve the oxidation resistance of the cold-rolled steel sheet.

Moreover, the method of production according to the second aspect of the present invention carries out annealing of hot-rolled steel sheet for a very short time within 300 seconds, and succeeds in practically producing cold-rolled steel sheets of martensitic stainless steel having improved workability, oxidation resistance, and corrosion resistance.

Accordingly, the stainless steel sheet of the present invention is useful over a wide range of applications, including western-style tableware, household items, and medical equipment. In addition, possible reduction of the time required for the production thereof is advantageous in reducing production costs.

We claim:

1. A stainless steel of martensitic grain structure having improved oxidation resistance, workability, and corrosion resistance consisting essentially of (in % by weight) 0.40% or less of C, 1.0% or less of Si, 1.0% or less of Mn, 0.6% or less of Ni, 10 to less than 14% of Cr, 0.05–0.20% of Al, and 0.025–0.060% of N, balance essentially iron.

2. A martensitic stainless steel having improved oxidation resistance, workability, and corrosion resistance according to claim 1 wherein said N content is 0.03–0.05%.

* * * * *